US005661911A

United States Patent [19]

Yli-Kauppila

[11] Patent Number: 5,661,911

[45] Date of Patent: Sep. 2, 1997

[54] DRYER SECTION OF A PAPER MACHINE

[75] Inventor: Jouko Yli-Kauppila, Muurame, Finland

[73] Assignee: Valmet Corporation, Helsinki, Finland

[21] Appl. No.: 622,069

[22] Filed: Mar. 26, 1996

Related U.S. Application Data

[63] Continuation-in-part of Ser. No. 389,952, Feb. 17, 1995, and a division of Ser. No. 389,952, Feb. 17, 1995.

[30] Foreign Application Priority Data

Feb. 17, 1994 [FI] Finland ..... 940749

[51] Int. Cl.[6] ..... F26B 11/02

[52] U.S. Cl. ..... 34/117; 34/119

[58] Field of Search ..... 34/111, 113, 114, 34/115, 116, 117, 119, 120, 454

[56] References Cited

U.S. PATENT DOCUMENTS

| | | | |
|---|---|---|---|
| 3,378,936 | 4/1968 | Buss | 34/116 |
| 3,658,642 | 4/1972 | Keyes, IV et al. | 162/197 |
| 3,753,298 | 8/1973 | Ely | 34/116 |
| 3,868,780 | 3/1975 | Soininen et al. | 34/116 |
| 4,441,263 | 4/1984 | Vedenpaa | 34/115 |
| 4,502,231 | 3/1985 | Fissman et al. | 34/114 |
| 4,516,330 | 5/1985 | Eskellnen et al. | 34/23 |
| 4,602,439 | 7/1986 | Eskellnen et al. | 34/23 |
| 4,661,198 | 4/1987 | Simmonds, Jr. et al. | 156/578 |
| 4,905,380 | 3/1990 | Eskellnen et al. | 34/23 |
| 4,972,608 | 11/1990 | Ilvespaa | 34/115 |
| 5,022,163 | 6/1991 | Ilvespaa et al. | 34/23 |
| 5,062,216 | 11/1991 | Hannigan | 34/117 X |
| 5,177,880 | 1/1993 | Preisetanz et al. | 34/117 |
| 5,269,074 | 12/1993 | Sims et al. | 34/117 |
| 5,331,749 | 7/1994 | Thiele | 34/117 |
| 5,426,867 | 6/1995 | Yli-Kauppila et al. | 34/452 |
| 5,517,765 | 5/1996 | Christansen | 34/116 |

FOREIGN PATENT DOCUMENTS

| | | |
|---|---|---|
| 53333 | 5/1974 | Finland . |
| 872691 | 6/1987 | Finland . |
| 904841 | 10/1990 | Finland . |
| 83441 | 3/1991 | Finland . |
| 934367 | 10/1993 | Finland . |
| 9521293 | 10/1995 | WIPO . |

OTHER PUBLICATIONS

"Paper Machine Ventilation", Tampella Ventilation, Apr. 1990.

Lars Nordman, Jan–Erik Levlin, Jukka Visti, "Kuivatuksen vaikulus paperirainan ominaisuukslin", Paperln valmistus, Suomen paperi–insinoorien opp–ja kasikirja III, osa 1; editor A. Arjas, Teknillisten tieteiden Akatemis, Turku 1982, pp. 705–724.

"The Valmet Sym–Run Concept" Paper Asia, May/Jun. 1992, pp. 38–42.

78th Annual Meeting Congress Annuel, Lindberg, Juppi, Eskelinen, "High Speed Section Developments for Sheet Stability", 78th Annual Meeting, Technical Section CPPA 1992.

*Primary Examiner*—John M. Sollecito
*Assistant Examiner*—Steve Gravini
*Attorney, Agent, or Firm*—Steinberg, Raskin & Davidson, P.C.

[57] ABSTRACT

A method and device for contact drying a paper web, wherein the paper web is dried initially in a number of successive groups with single-wire draw by pressing the paper web via drying wires of each groups against the heated faces of the drying cylinders and by guiding the paper web on support of the same drying wire from one drying cylinder onto the next drying cylinder over the reversing suction cylinders or rolls in each group with single-wire draw. In the groups with single-wire draw, the paper web is dried to a first dry solids content, after which the paper web is dried directly further by a single group with twin-wire draw to a second dry solids content, after which the paper web is dried further to its final dry solids content by a single normal group with single-wire draw. The limits of the first and second dry solids contents are selected so that, in the middle or in the beginning of the range, the tear strength index and the breaking strength index of the web are at their maximum.

20 Claims, 7 Drawing Sheets

DRYER SECTION OF A PAPER MACHINE

This application is a CIP of Ser. No. 389,952, filed Feb. 17, 1995 and a divisional of U.S. Ser. No. 08/389,952 filed Feb. 17, 1995.

BACKGROUND OF THE INVENTION

The present invention relates to an arrangement in contact drying of a paper web, wherein the paper web is dried on heated smooth-faced drying cylinders by means of a number of successive so-called normal groups with single-wire draw, in which the drying cylinders are placed in an upper row and reversing suction cylinders or equivalent reversing suction rolls are placed in the lower row. After the press section of the paper machine, the paper web is dried initially in a number of successive drying groups with single-wire draw by pressing the paper web by means of the drying wires of the drying groups against the heated faces of the drying cylinders and, in each group with single-wire draw, by guiding the paper web on support of the same drying wire from one drying cylinder onto the next drying cylinder over the reversing suction cylinders or rolls. When the paper web is placed on the drying wire at the side of the outside curve, the web is kept on the drying wires by means of a difference in pressure against the effect of centrifugal forces.

The invention also relates to a dryer section of a paper machine, which is composed of a number of successive so-called normal groups with single-wire draw, from the start thereof and over the major part of its length, in which the drying cylinders are placed in the upper row and the reversing suction cylinders or corresponding suction rolls are placed in the lower row. Between the normal groups, the paper web to be dried has closed draws over the group gaps. The reversing suction cylinders or corresponding suction rolls are arranged to be subjected to a vacuum, at least in respect of their turning sectors of the drying wire.

In the manner known from the prior art, in multi-cylinder dryers of paper machines, twin-wire draw and/or single-wire draw is/are employed. In twin-wire draw, the groups of drying cylinders include two wires which press the web, one from above and the other one from below, against the heated cylinder faces. Between the rows of drying cylinders, which are usually horizontal rows, the web has free and unsupported draws which are susceptible of fluttering and may cause web breaks, in particular since the web is still relatively moist and, therefore, has a low strength. For this reason, in recent years, increasing use has been made of a single-wire draw, in which each group of drying cylinders has one drying wire only, on whose support the web runs through the whole group so that the drying wire presses the web on the drying cylinders against the heated cylinder faces, whereas, on the reversing cylinders or rolls between the drying cylinders, the web remains at the side of the outside curve. Thus, in single-wire draw, the drying cylinders are placed outside the drying wire loop and the reversing cylinders or rolls are placed inside the loop.

In dryer sections that comprise inverted and normal drying groups, various problems have occurred, for which problems the present invention suggests novel, efficient solutions. These problems include the large length of the dryer section which increases the costs of the dryer section and of the machine hall. Problems have also been encountered in the runnability of the dryer section and in the threading of the web, problems arising from differences in the speeds of different wires, as well as problems related to the control of transverse shrinkage of the web.

In inverted drying groups, in the event of web breaks, a further problem consists of the removal of broke, for inverted groups are not self-cleaning by the force of gravity. Generally, these problems tend to become worse as the running speed of the paper machine becomes higher.

In prior art dryer sections in which exclusively groups with single-wire draw are used, in the last wire groups, considerable wear of the drying fabrics has occurred, in particular in the manufacture of fine papers with a high content of fillers. Thus, the present invention is also directed to reducing this problem which occurs in the drying groups driven by the drying wire because of the considerable thickness of the drying wire. The differences in speed mentioned above, together with a restricted drying shrinkage, have caused web breaks in the last groups when exclusively single-wire draw has been used. This problem is emphasized further if, in the groups with single-wire draw, small-diameter suction rolls proper are used that are provided with an inside suction box. In order to eliminate this problem, in some machines, it has been even necessary to open some group gaps and to lower the level of negative pressure in the suction rolls. Problems similar or corresponding to those described above are encountered, e.g., in the dryer section described in the U.S. Pat. No. 5,269,074 (assigned to Beloit Corp.), wherein in the groups with single-wire draw, normal suction rolls are used which have very small diameters and which are provided with inside suction boxes. Moreover, in this patent, a dryer section is described in which the last group is a single group with twin-wire draw, in which there are two rows of drying cylinders placed one row above the other, the web having free draws between these rows. A dryer section similar to that mentioned above is also described in the assignee's Finnish Patent Application No. 934367 (filed on Oct. 5, 1993 and corresponding to U.S. patent application Ser. No. 08/213,148, the specification of which is hereby incorporated by reference herein).

In the above-mentioned U.S. patent and Finnish patent application, it has been the starting point that the tensile strength of a paper web is increased substantially when its dry solids content becomes higher, so that it has been considered that the group with twin-wire draw should be placed preferably expressly as the last group in whose area the dry solids content of the web is at the maximum, and so is the tensile strength at the maximum in view of elimination of the problems of runnability produced by the free draws of the web. Then, consideration has, however, not been given to the fact that the susceptibility of breaks at the free draws of the web does not depend on the tensile strength of the web alone, but also on the breaking strength (tensile-energy absorption) and the tear strength in particular in respect of breaks and wrinkles starting in the lateral areas of the web.

With respect to the different strength properties of the paper web, reference is made in this connection to the paper by Lars Nordman, Jan-Erik Levlin and Jukka Visti entitled "Kuivatuksen vaikutus paperirainan ominaisuuksiin", Paperin valmistus, Suomen paperi insinoorien oppi- ja kasikirja III, osa 1; editor A. Arjas, Teknillisten tieteiden Akatemia, Turku 1982, pages 705–724.

OBJECTS AND SUMMARY OF THE INVENTION

Accordingly, it is an object of the present invention to further develop the dryer section described in FI 934367, in particular so that the control of curling of the paper web can be improved. In this respect, further development has been necessary, because the shrinkage of the web is at the maximum in the area of the last group with twin-wire draw, as will be described in more detail later. The object of the present invention is to achieve the above objective while, nevertheless, keeping the runnability of the paper machine at least equally good as in the dryer sections as described in FI 934367 and in U.S. Pat. No. 5,269,074, or, in some special cases, even to improve the runnability of the paper machine.

Another object of the present invention is to provide a novel drying method and dryer section in which a final portion of the dryer section is used that has been arranged in such a way that, in the final portion, the paper web is provided with the opportunity and time to relax in the free gaps so that breaks arising from internal strains in the web are substantially eliminated.

It is another object of the present invention to provide a dryer section in which inverted drying groups are not needed at all but which, nevertheless, meets the other requirements that are imposed on a dryer section.

It is a further object of the present invention to provide a dryer section in which so-called ropeless tail threading can be applied favorably over the entire length of the dryer section in the machine direction, which contributes to making the constructions simpler and the standstill times shorter.

In view of achieving the objects stated above, and others, in the method in accordance with the invention, by means of drying groups with single-wire draw, the paper web is dried to a certain dry solids content $k_1$ and that after the above drying stages carried out exclusively by means of normal groups with single-wire draw, the paper web is dried directly further by means of a single group with twin-wire draw to a certain dry solids content $k_2$. Thereafter, the paper web is dried further to the ultimate dry solids content $k_{out}$ by means of one single group with single-wire draw, in which the drying cylinders are placed above and the reversing suction cylinders or the equivalent reversing suction rolls are placed underneath, or some other, corresponding geometry of positioning of the cylinders is used that is open downward, and that the limits of dry solids contents $k_1$ and $k_2$, between which the single group with twin-wire draw operates, are selected such that, in the middle area or in the area of the initial end of the range of dry solids contents, the tear strength index and the breaking strength index of the web are at the maximum.

In a preferred embodiment of the method of the invention, by means of the groups with single-wire draw, the paper web is initially dried to a dry solids content of $k_1$ from about 65% to about 85%, and after these drying steps that were carried out exclusively by means of normal groups with single-wire draw, the paper web is dried directly further by means of one single group with twin-wire draw to a dry solids content of $k_2$ from about 80% to about 95%, after which the paper web is dried further to the ultimate dry solids content $k_{out}$ by means of one single group with single-wire draw, in which the drying cylinders are placed above and the reversing suction cylinders or equivalent suction rolls are placed underneath, or some other, equivalent geometry of location of cylinders is used that is open downward.

In the dryer section in accordance with the invention, after the last one of the groups with single-wire draw mentioned above, one single group with twin-wire draw has been arranged in which there are two rows of drying cylinders placed one above the other. The drying group with twin-wire draw is followed directly by a group with single-wire draw which is the last wire group in the dryer section and in which the drying cylinders are placed in the upper row and the reversing suction cylinders or equivalent underneath, being placed so that the last group with single-wire draw is open downward.

Even though, in the present invention, the group with twin-wire draw is not the last wire group, which is the case in the above-mentioned Finnish patent application and U.S. patent, by means of the dryer section of the present invention an at least equally good, in some cases even better, runnability is achieved, for in the present invention the group with twin-wire draw is placed in the very area, regarding the dry solids content of the web, in which the breaking strength and the tear strength of the web are at the maximum, as will come out in more detail later, in spite of the fact that the tensile strength is developed in a substantially linear way as a function of the dry solids content. The advantage mentioned above comes partly from the fact that, in the area with twin-wire draw, the upper wire and the lower wire have the same speed, compared with one another, so that the web is not subjected to a difference in speed on the free unsupported draws between the rolls of cylinders, for which reason the tensile strength of the web is not the most essential factor in view of the runnability in this area. The foregoing analysis is an observation of fundamental nature in view of the present invention.

According to the invention, in the single group with twin-wire draw, which is the second last wire group in the dryer section, it is favorably possible to employ free draws of the paper web between the rows of cylinders in the wire group, on which free draws the paper web is allowed to relax. Alternatively, or additionally, in the group with twin-wire draw, it is also possible to employ fully closed draws between the rows of cylinders, for example such as are illustrated in FIGS. 3 and 4 in the assignee's Finnish Patent 68,279 (corresponding to the assignee's U.S. Pat. No. 4,602,439, the specification of which is hereby incorporated by reference herein), or other, corresponding prior art draw arrangements.

In the dryer section in accordance with the present invention, the transverse shrinkage of the web may become just slightly larger as compared with a situation in which the web is dried by means of a dryer section exclusively consisting of groups with single-wire draw. However, in the present invention the shrinkage of the web in the cross direction can be made smaller than in the dryer sections described in the above-mentioned Finnish patent application and U.S. patent in which the last group is a group with twin-wire draw, because in the area of this last group, the drying-shrinkage is at the maximum. With regard to the shrinkage of the paper web, in this connection reference is made to the cited paper in Paper Asia, May/June 1992, pp. 38–42 and to the accompanying FIG. 3.

In the present invention, by means of a combination of a number of process steps end structural arrangements that am known in themselves from the prior art, it has been possible to create a dryer section that is more advantageous both in respect of its construction and in respect of its runnability. The paper produced by means of such a dryer section having quality properties that meet even high requirements, also in respect of symmetry and dimensional stability.

According to the invention, in the group with twin-wire draw, which is placed as the second to last or penultimate wire group, the drying proportion of the top side of the web can be increased so as to provide a sufficiently symmetric drying, because in the groups with single-wire draw in the initial part of the dryer section the drying had been applied to the bottom side of the web on the upper cylinders in the wire groups. This equalization of the drying proportions can be carried out, for example, so that, in the group with twin-wire draw, the cylinders in the lower row have larger diameters, the tension of the lower wire is higher than that of the upper wire, in the lower cylinders a higher steam pressure is employed than in the upper cylinders, and/or the lower cylinders are provided with larger diameters or larger web-covering sectors than the upper cylinders, so that the proportion of the drying applied to the top face of the web is increased.

In the present invention, the last normal (not inverted) group with single-wire draw is preferably relatively shod, so that it comprises, for example, two to four drying cylinders, preferably three drying cylinders, as the cylinders in the upper row and two to three lower reversing cylinders.

It is also an important aspect of a dryer section in accordance with the invention which includes only normal single-wire draw groups preceding the twin-wire draw group that it expressly does not include inverted single-wire draw groups, i.e., in which the row of heated drying cylinders is situated below the row of reversing suction rolls. Very often in prior art dryer section constructions when providing a plurality of single-wire draw groups, it is usually the case that at least one inverted single-wire draw group is included in order to dry an opposite side of the web from the side being dried in the normal single-wire draw groups. However, the dryer section in accordance with the invention is constructed to avoid the need for such an inverted group and thus comprises exclusively normal groups preceding the twin-wire draw group.

In certain embodiments of the dryer section in accordance with the invention, the web is supported during its transfer between adjacent dryer groups, i.e., there are closed draws between the adjacent dryer groups. This provides the advantages of enabling an increase in the running speed of the web and the runnability of the web in general in view of the absence of free, unsupported draws in which the web is susceptible to breaks.

In the following, the invention will be described in detail with reference to some exemplifying embodiments of the invention schematically illustrated in the figures in the accompanying drawing. However, the invention is by no means strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
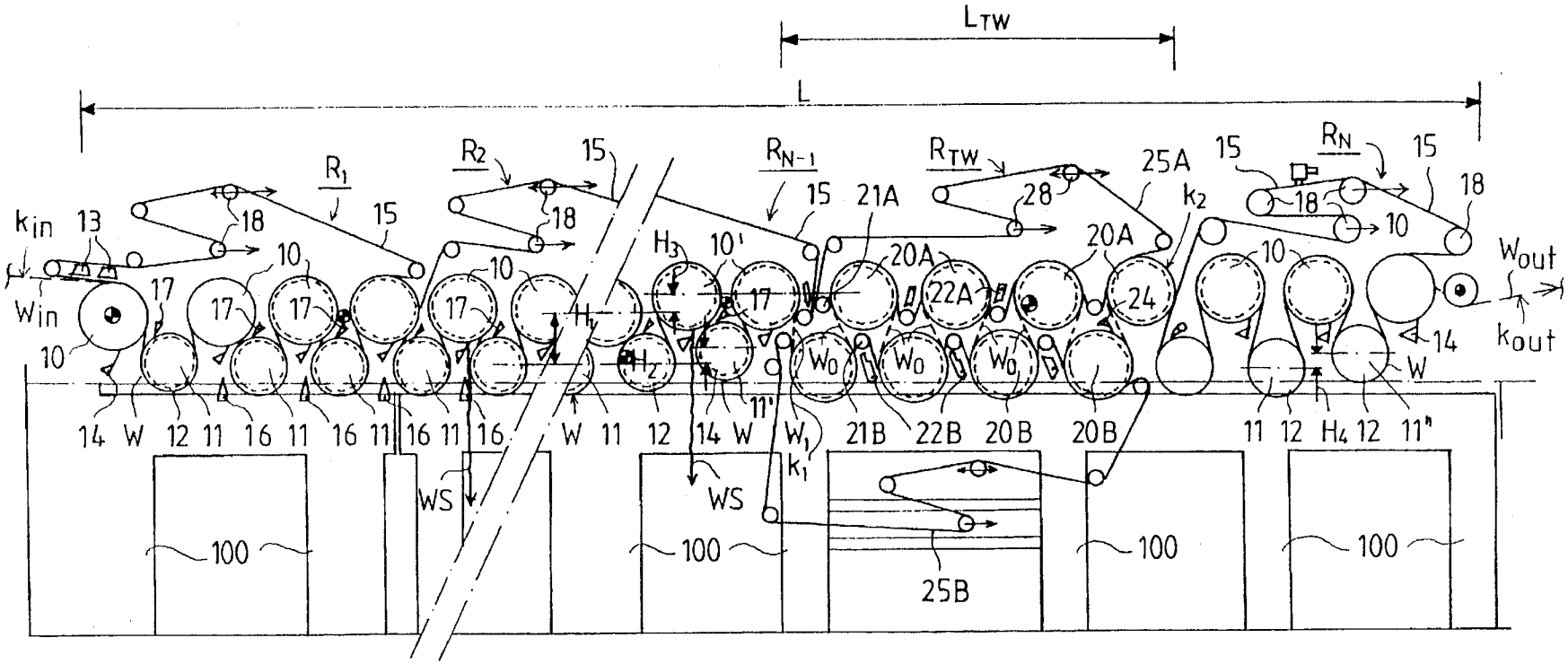
FIG. 1 is a schematic side view of a dryer section in accordance with the invention that makes use of the method of the invention.

Referring to the accompanying drawings wherein like reference numerals refer to the same elements, as shown in FIG. 1, a paper web $W_{in}$ is passed to a dryer section of a paper machine from a press section (not shown) of the paper machine onto a drying wire 15 of a first group with single-wire draw $R_1$. The web is made to adhere to wire 15 by the effect of the negative pressure produced by blow boxes 13. The dryer section comprises N groups with single-wire draw $R_1, R_2, \ldots, R_{N-1}, R_N$. In the group gaps $R_1, \ldots, R_{N-1}$ the web W has closed draws. In a dryer section in accordance with the invention, the number of normal groups $R_{1, \ldots, N}$ is from about 3 to about 9, preferably N is from 5 to 7, and typically N is 6. All the groups with single-wire draw $R_1, \ldots, R_N$ are so-called normal groups, in which steam-heated smooth-faced drying cylinders 10 are placed in a first, upper horizontal row and reversing suction cylinders 11 or equivalent suction rolls are placed in a second, lower horizontal row below the first, upper row. In the second to last or penultimate normal group $R_{N-1}$, the last two upper cylinders 10' and the single reversing suction cylinder 11' placed between them are displaced by the measure $H_3$ higher than in the preceding groups $R_1, \ldots, R_{N-1}$. The measure $H_3$ is typically about 400 mm. The frame part 100 of the dryer section is illustrated quite schematically. According to the present invention, the second to last or penultimate group in the dryer section is a group with twin-wire draw $R_{TW}$, and the last group is a so-called normal group with single-wire draw $R_N$. Thus, in a dryer section in accordance with the invention, there are no so-called inverted groups with single wire draw at all, and, thus, the problems of broke removal or equivalent related to such inverted groups do not occur in the inventive dryer section. In an inverted group, the drying cylinders are arranged in a first, lower row and the reversing suction cylinders or suction rolls are arranged in an second, upper row over the first, lower row of drying cylinders.

Each normal group $R_1, \ldots, R_N$ has a drying wire 15 of its own, which wire is guided by guide rolls 18. The drying wires 15 press the web W to be dried on the drying cylinders 10 against their smooth heated faces, and on the reversing cylinders 11 the web W remains at the side of the outside curve on the outer face of the wire 15. On the reversing cylinders 11, the web W is kept reliably on support of the wire 15 against the effects of centrifugal forces by the effect of the negative pressure present in grooved faces 12 of the reversing cylinders 11, whereby transverse shrinkage of the web W is also counteracted. The reversing suction cylinders 11 that are used are preferably suction cylinders marketed by the applicant under the trade mark VAC-ROLL"™, which cylinders do not have inside suction boxes and with respect to the details of whose construction reference is made to the assignee's Finnish Patent No. 83,680 (corresponding to the current assignee's U.S. Pat. No. 5,022,163, the specification of which is hereby incorporated by reference herein). However, it should be emphasized that the scope of the invention also includes dryer sections in which, in the positions of the reversing cylinders 11, ordinary suction rolls provided with an inside suction box are used, also including suction rolls having relatively small diameters. Normal suction rolls, in particular suction rolls of small diameters (D is about 600 to about 1000 mm), are, however, in this connection, not as favorable as the "VAC-ROLL"™ rolls are for the reasons that were discussed above.

In a preferred embodiment of the invention, the support contact between the web W and the drying wire 15 is also kept adequate on the straight runs between the drying cylinders 10 and the reversing cylinders 11, at least on the runs from the drying cylinders 10 to the reversing cylinders 11, by employing blow-suction boxes 17. By means of suction boxes 17, formation of pressures induced by the wire 15 is also prevented in the closing wedge-shaped nip spaces between the wire 15 and the mantles of cylinders 11. With respect to the details of the constructions of these blow-suction boxes 17, which are marketed by the assignee under the trade mark "UNO RUN BLOW BOX"™, reference is made to the assignee's Finnish Patent Nos. 59,637, 65,460 and 80,491 (corresponding to the assignee's U.S. Pat. Nos. 4,441,263, 4,516,330 and 4,905,380, respectively, the specifications of which are hereby incorporated by reference herein). After the introduction of the "UNO RUN BLOW BOX"™, the assignee's competitors have also suggested some constructions of blow boxes, with respect to which reference is made to U.S. Pat. Nos. 4,502,231 (assigned to J. M. Voith GmbH) and 4,661,198 (assigned to Beloit Corp.). The applications of these blow boxes in the positions of the blow boxes 17 is also included in the scope of the overall concept of the present invention.

In the groups $R_1, \ldots, R_N$ with single-wire draw, if necessary, blow boxes 16 can also be used in the gaps between the reversing cylinders 11. By means of blow boxes 16, the intermediate spaces are air-conditioned and evaporation from the web W is promoted. The faces of the drying cylinders 10 are kept clean by doctors 14 or other suitable cleaning means.

In the invention, it is a further important feature and advantage that broke removal by the force of gravity can be applied in the groups $R_1, \ldots, R_N$ with single-wire draw, which extend over the major part of the overall length L of the dryer section, because the groups $R_1, \ldots, R_N$ with single-wire draw are open toward the bottom so that the paper web WS that becomes broke can be removed without any particular arrangements onto the broke conveyor (not shown) placed in the basement space of the paper machine.

In the normal groups $R_1, \ldots, R_{N-1}$, the web W has time to reach a certain, quite high dry solids content ($k_1$) from about 65% to about 85%, depending on the paper grade, and, for example, in the case of newsprint preferably $k_1$ is from about 72% to about 77%. At this dry solids content $k_1$, the web W is so strong that, for its further drying, it is possible to apply a group with twin-wire draw $R_{TW}$ without risking detrimental web breaks. Thus, it is an essential feature of the invention that, in the final end of the dryer section, expressly as the second to last or penultimate wire group, there is one single group $R_{TW}$ with twin-wire draw. In this single twin-wire group $R_{TW}$, there are two horizontal rows of contact-drying cylinders 20A and 20B, one row placed above the other. In connection with the upper cylinders 20A, there is an upper wire 25A, which is guided by wire guide rolls 21A arranged in the gaps between the cylinders 20A and by other guide rolls 28. The web W is pressed into a drying contact against the heated faces of the lower cylinders 20B by means of a lower wire 25B which is guided by the wire guide rolls 21B arranged in gaps between the cylinders 20B and by other guide rolls 28. In the twin-wire group $R_{TW}$ the web W is dried from both sides so that, after the twin-wire group $R_{TW}$, the dry solids content of the web W ($k_2$) is from about 80% to about 95%, depending on the paper grade, and, for example, in the case of newsprint preferably $k_2$ is from about 85% to about 90%.

According to FIG. 1, in the twin-wire group $R_{TW}$, a draw arrangement marketed by the assignee under the trade mark "TWIN-RUN"™ is used, in which the guide rolls 21A and 21B are placed so that the drying wires 25A and 25B accompany the web from the drying cylinders 20A and 20B onto the subsequent drying cylinder in the travel direction of the web so that the free draws $W_o$ of the web W can be made shorter, as compared with free draws of full length. In this draw arrangement, in proximity to the wire guide rolls 21A and 21B and at the inlet side of the web W and the drying wire 25A and 25B, air-blow boxes 22A,22B are used. Out of the blow boxes 22A,22B, which are used in the "TWIN-RUN"™ concept and which are arranged in the gaps between the drying cylinders 20A,20B, air jets of suitable direction and blow velocity are applied to the vicinity of the runs of the drying wires 25A,25B placed at their proximity and to the vicinity of the free sectors of the wire guide rolls 21A,21B. By means of these air jets, support contact between the drying wires 25A,25B and the web W is promoted, and formation of detrimental differences in pressure and fluttering of the web W on the free draws W0 are prevented. These blowings can also be applied through the drying wires 25A,25B, whereby it is possible to promote the ventilation of the pocket spaces P formed in the gaps between the drying cylinders 20A,20B. With respect to the further details of the "TWIN-RUN"™ concept and of blow boxes 22A,22B, reference is made to the assignee's Finnish Patent No. 80,103 (FI Patent Application No. 872691 corresponding to DE 38 18 600 and U.S. patent application Ser. No. 07/209,061).

In connection with the drying cylinders 20A,20B, there are doctors 24 operating against the outer faces thereof. As shown in FIG. 1, the last two cylinders 10' in the last normal group $R_{N-1}$ are placed in the same horizontal plane as the upper cylinders 20A in the single twin-wire group $R_{TW}$, whereby it is possible to guarantee a transfer of the web W without problems. The web W is passed from the last drying cylinder 10 in the second to last normal group $R_{N-1}$ onto the first lower cylinder 20B in the single twin-wire group $R_{TW}$ as an open draw $W_1$, whose arrangement is similar to the free internal draws $W_o$ of the web W in the twin-wire group $R_{TW}$. FIG. 2B shows a dryer section in which there is an open draw $W_1$ between the penultimate normal group $R_{N-1}$ and the single twin-wire group $R_{TW}$, as shown in FIG. 1, as well as between the single twin-wire group $R_{TW}$ and the last normal group $R_N$.

Figures 3, 4, 5:
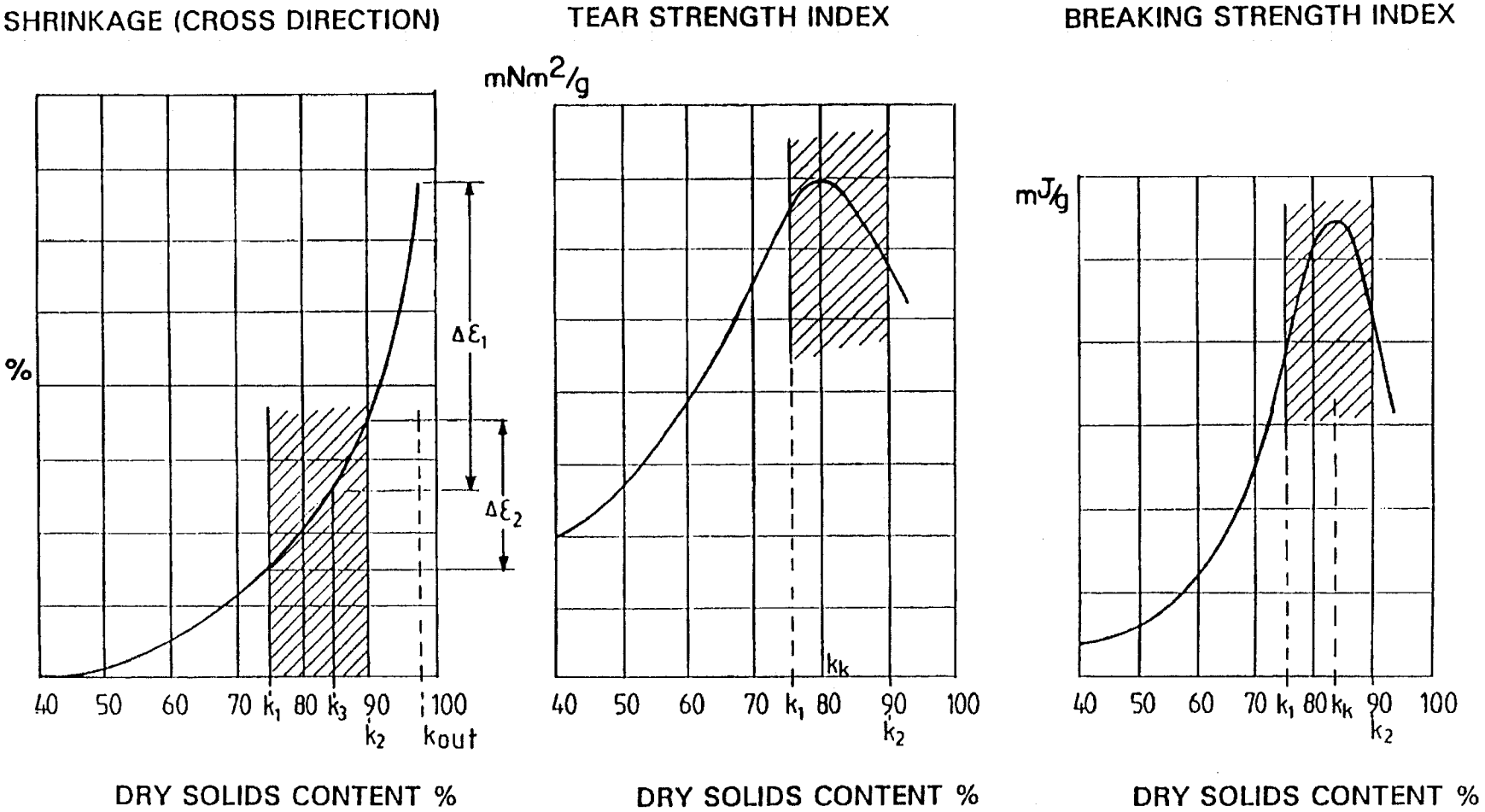
FIG. 3 illustrates the percentage of shrinkage of a paper web as a function of the dry solids content in a dryer section exclusively provided with single-wire draw.
FIG. 4 illustrates a tear strength index of a newsprint web as a function of the dry solids content of the web.
FIG. 5 illustrates a breaking strength index of a web as a function of the dry solids content of the web.

The advantages obtained by means of the present invention in respect of the drying shrinkage will be described in more detail with reference to FIG. 3, in which a typical shrinkage curve of paper is illustrated as a function of the percentage of dry solids content. According to the invention, the single group with twin-wire draw $R_{TW}$ is placed in the range of dry solids content from $k_1$ to $k_2$, which area is diagonally shaded (from 75% to 90%). The drying shrinkage of the paper web taking place in this area being denoted with $\Delta\epsilon 2$. Since the steepness of the rise in the drying shrinkage in the cross direction increases in a substantially linear manner as the percentage of dry solids content becomes higher, in the range of dry solids content from $k_3$ to $k_{out}$, the drying shrinkage is substantially higher than in the range from $k_1$ to $k_2$. The range $k_3$ to $k_{out}$ substantially corresponds to the range in which the last single group with twin-wire draw operates in the dryer section in accordance with the above-mentioned Finnish patent application no. 934367 and U.S. Pat. No. 5,269,074. From FIG. 3, it is seen that the shrinkage $\Delta\epsilon_1 \approx 2x\Delta\epsilon_2$ so that by means of the present invention, a shrinkage is obtained that is substantially lower than in the dryer sections in accordance with the above-mentioned Finnish patent application and U.S. patent. With reference to FIG. 3, it can be noticed further that the internal strain arising in the paper along with its drying behaves in a manner substantially similar to the shrinkage in the cross direction as a function of the dry solids content.

In the following, with reference to FIGS. 4 and 5, the specific reasons why, in the present invention, the area with twin-wire draw $R_{TW}$ is placed in an area optimal also in view of the runnability of the paper machine even though free draws $W_o$ of the web W may be used, which are susceptible of fluttering. It is common knowledge that the tensile strength of paper increases in a substantially linear fashion as the percentage of dry solids content increases. FIG. 4 illustrates a typical tear strength index of newsprint as a function of the percentage of dry solids content. As seen in FIG. 4, in the area of the group with twin-wire draw $R_{TW}$, which is placed in the range of dry solids content from $k_2$ to k (diagonally shaded) in accordance with the present invention, the maximum value of the tear strength index is reached when the percentage of dry solids content is $k_k$. After this point, the tear strength index becomes lower steeply as the dry solids content increases further. A corresponding observation can also be made regarding the breaking strength index (tensile-energy absorption) of paper illustrated in FIG. 5. Thus, in the present invention, the group with twin-wire draw $R_{TW}$ is placed so that, in its area, the web W to be dried has the maximal values both of its tear strength index and its breaking strength index preferably placed so that the maximal value is placed in the middle area or in the initial end of the range of dry solids content from $k_1$ to $k_2$ at the point $k_k$.

In FIG. 1, the overall horizontal length (L) of the dryer section in the machine direction is about 70 m when six normal groups $R_1, \ldots N$ (N=6) are used, and the corresponding horizontal length ($L_{TW}$) of the single twin-wire group $R_{TW}$ is about 10 m, when four upper cylinders 20A and four lower cylinders 20B are used in the twin-wire group $R_{TW}$. In the example given above, the length $L_{TW}$ of the twin-wire group $R_{TW}$ is about 14% of the overall length L. Generally, the length of the single twin-wire group $L_{TW}$ is from about 10% to about 20%, preferably from about 12% to about 16%, of the overall horizontal length L of the dryer section. In a dryer section concept in accordance with this dimensioning example, in practice, a reduction of about 5 meters is achieved in the overall length L of the dryer section, as compared with a situation in which exclusively groups with single-wire draw are employed. As a result of this decrease in dryer section length, the costs of the construction investment in the paper machine hall and the other costs indirectly related to same are also reduced considerably.

The number $N_1$ of the drying cylinders 10 used in the normal groups $R_1, \ldots, N-1$ in the initial end is in a range of $N_1$=4 to 8, preferably $N_1$ is 4 to 6, and the total number ($N_2$) of the drying cylinders 20A and 20B used in the single twin-wire group $R_{TW}$ is about 4 to about 14, preferably 8 to 10.

The number $N_3$ of the drying cylinders 10 in the last single group with single-wire draw $R_N$ is generally in the range of 2 to 4, preferably 3, and the number$_4$N of the reversing cylinders 11 in the group $R_N$ is generally in the range of 2 to 5, most appropriately 2 to 3. With the numbers of cylinders given above, it is possible to arrange the group with twin-wire draw $R_{TW}$ within the range of dry solids content $k_1$ to $k_2$, in whose middle area the breaking strength and the tear strength of the web are at the maximum (FIGS. 4 and 5), which guarantees a good running quality and minimizing of the risk of breaks even on unsupported free draws $W_o$ of the web W in the group with twin-wire draw $R_{TW}$.

With a view toward preventing transverse shrinkage of the web W, it is particularly important that the web W is kept constantly in tight contact with the drying wires 15 in the area of single-wire draw while aided by a difference in pressure. This holding or retention effect is produced on the reversing cylinders 11 by means of the negative pressure present in the grooved mantle 12 of their outer face and on the straight draws between the cylinders 10 and the reversing cylinders 11 by means of suitable pressure levels induced by means of blow-suction boxes 17.

Figure 2:
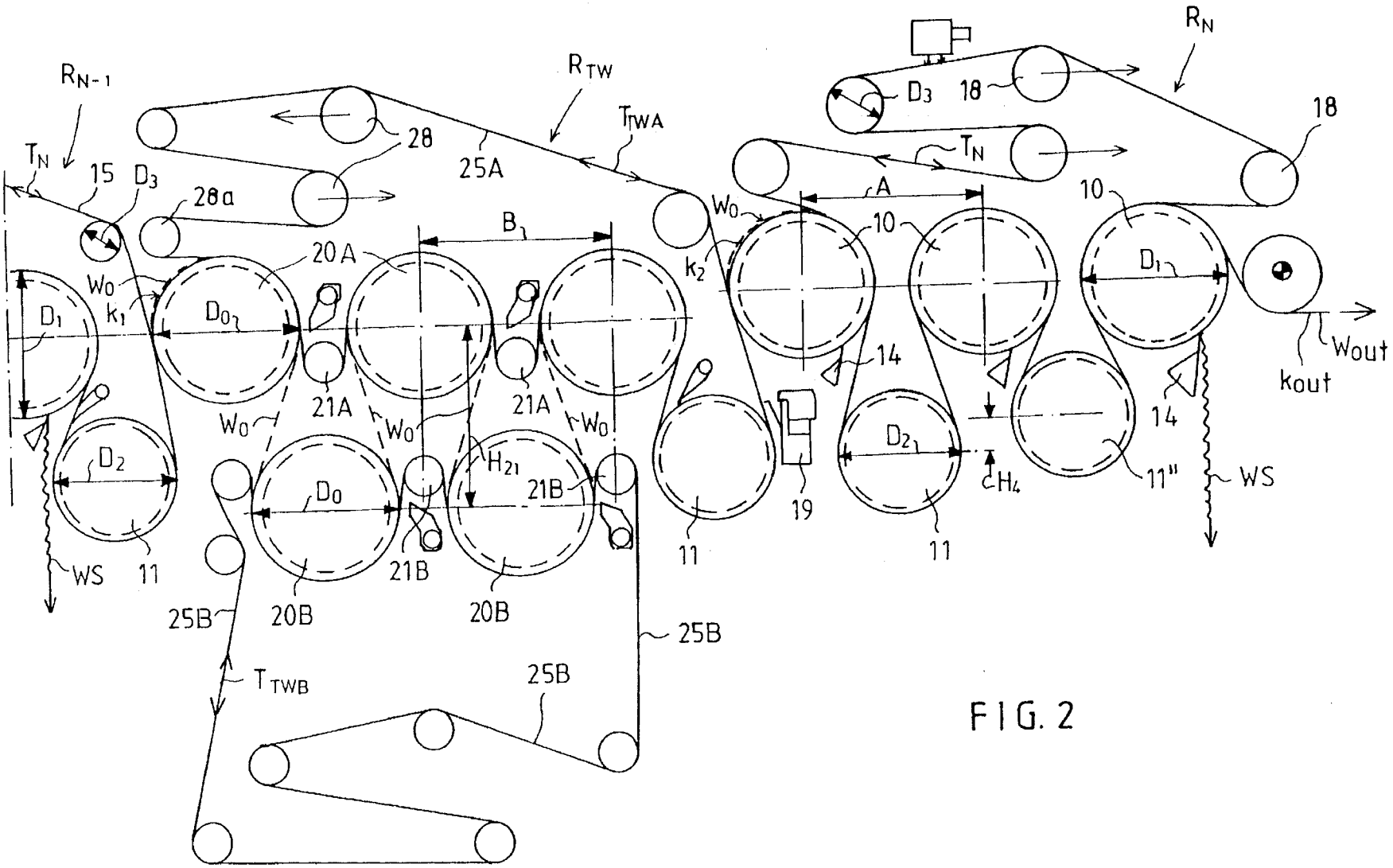
FIG. 2 shows a second modification of the dryer section in accordance with the invention.

FIG. 2 shows an embodiment of the invention in which closed draws of the web W are employed in the group gaps between the penultimate normal group $R_{N-1}$ and the twin-wire group $R_{TW}$ and between the twin-wire group $R_{TW}$ and the last normal group $R_N$. Of these dosed draws, the former closed draw has been achieved by passing the drying wire 15 and the web W supported on it into contact with the first upper cylinder 20A in the single twin-wire group $R_{TW}$, to whose smooth face the web W adheres and is transferred. The web is then pressed by the upper wire 25A guided by the guide roll 28*a* over the first upper cylinder 20A in the group $R_{TW}$. In FIG. 2, the guide rolls 21A and 21B placed in the gaps between the drying cylinders 20A and 20B are placed symmetrically in a center plane passing through the center axis of the adjacent drying cylinder, in which case the free draws W0 of the web W passing between the rows of cylinders 20A and 20B are of full length and unshortened, differing from the "TWIN-RUN"™ arrangement shown in FIG. 1. This arrangement is also included in the scope of the present invention even though it is not in all cases equally advantageous as the shortened free gaps $W_o$ shown in FIG. 1. A drawback of the free draws $W_o$ of full length is a slightly higher tendency of fluttering of the web W, but on the other hand, longer free gaps $W_o$ allow more time for evaporation of water and for relaxing of the web tensions in the gaps $W_o$ between the rows of cylinders 20A and 20B.

FIG. 20 shows an embodiment similar to the embodiment shown in FIG. 2 in that there are closed draws between the single-wire groups immediately preceding and following the single twin-wire draw group. Herein, the closed draws are structured such that the drying wire in group $R_{N-1}$ wraps around a contact sector of the first drying cylinder 20A in the upper row in the twin-wire draw group and the upper wire in the twin-wire draw group wraps around a contact sector of a first cylinder 10 in the last normal group with single-wire draw. This aids in transfer of the web between the adjacent wire groups.

Figure 2A:
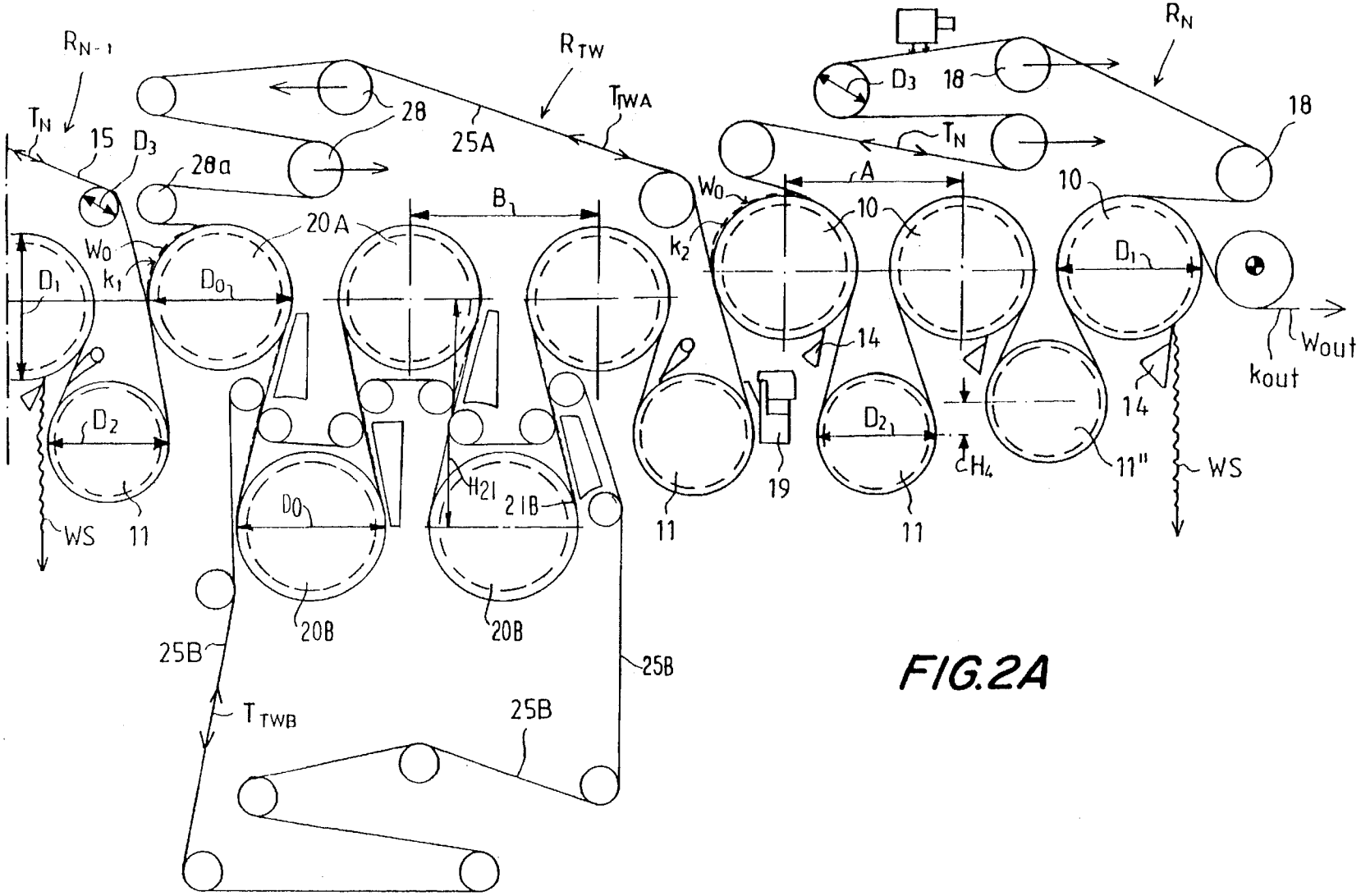
FIG. 2A shows a third modification of the dryer section in accordance with the invention.
Figure 2B:
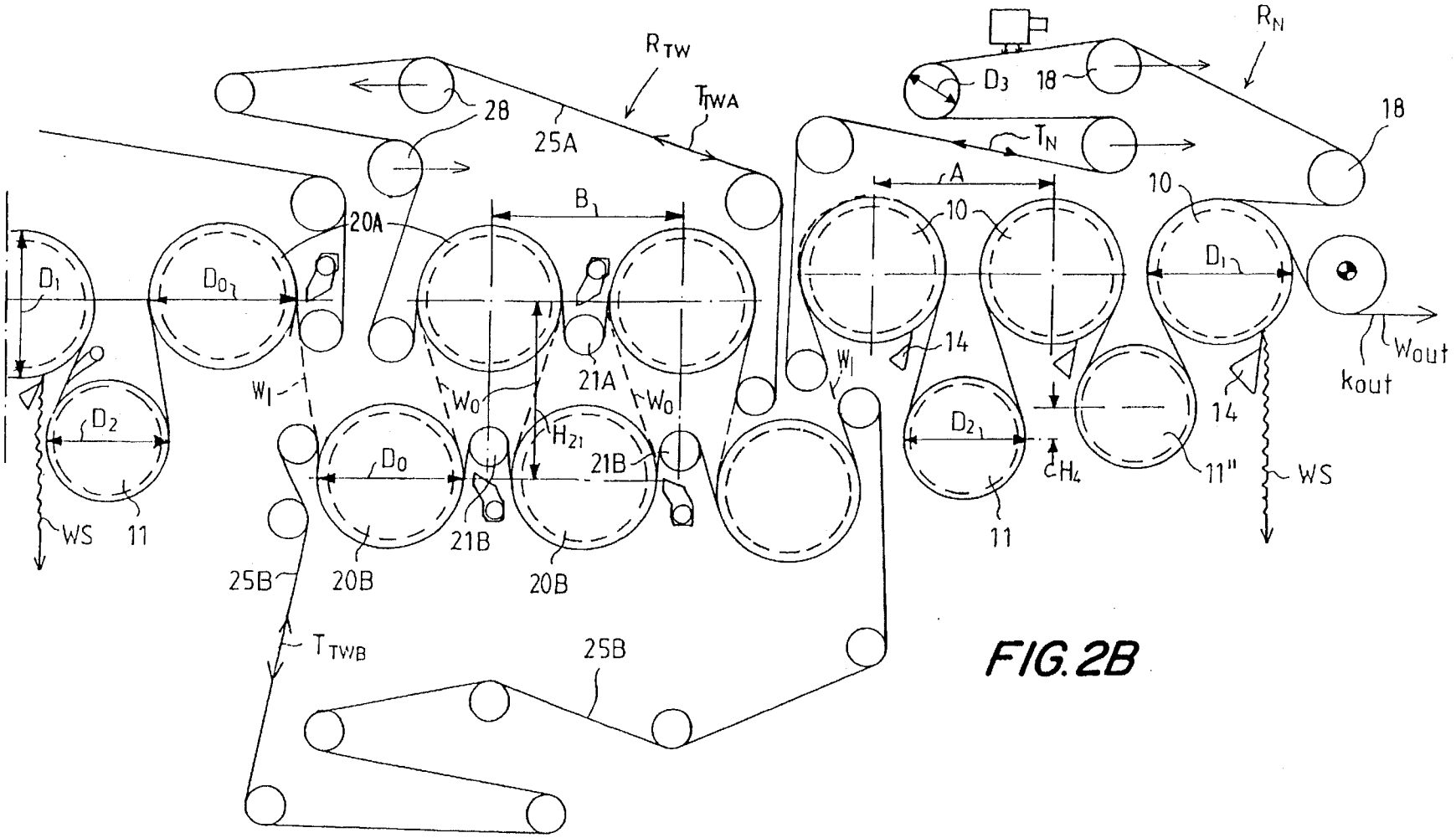
FIG. 2B shows a fourth modification of the dryer section in accordance with the invention.
Figure 2C:
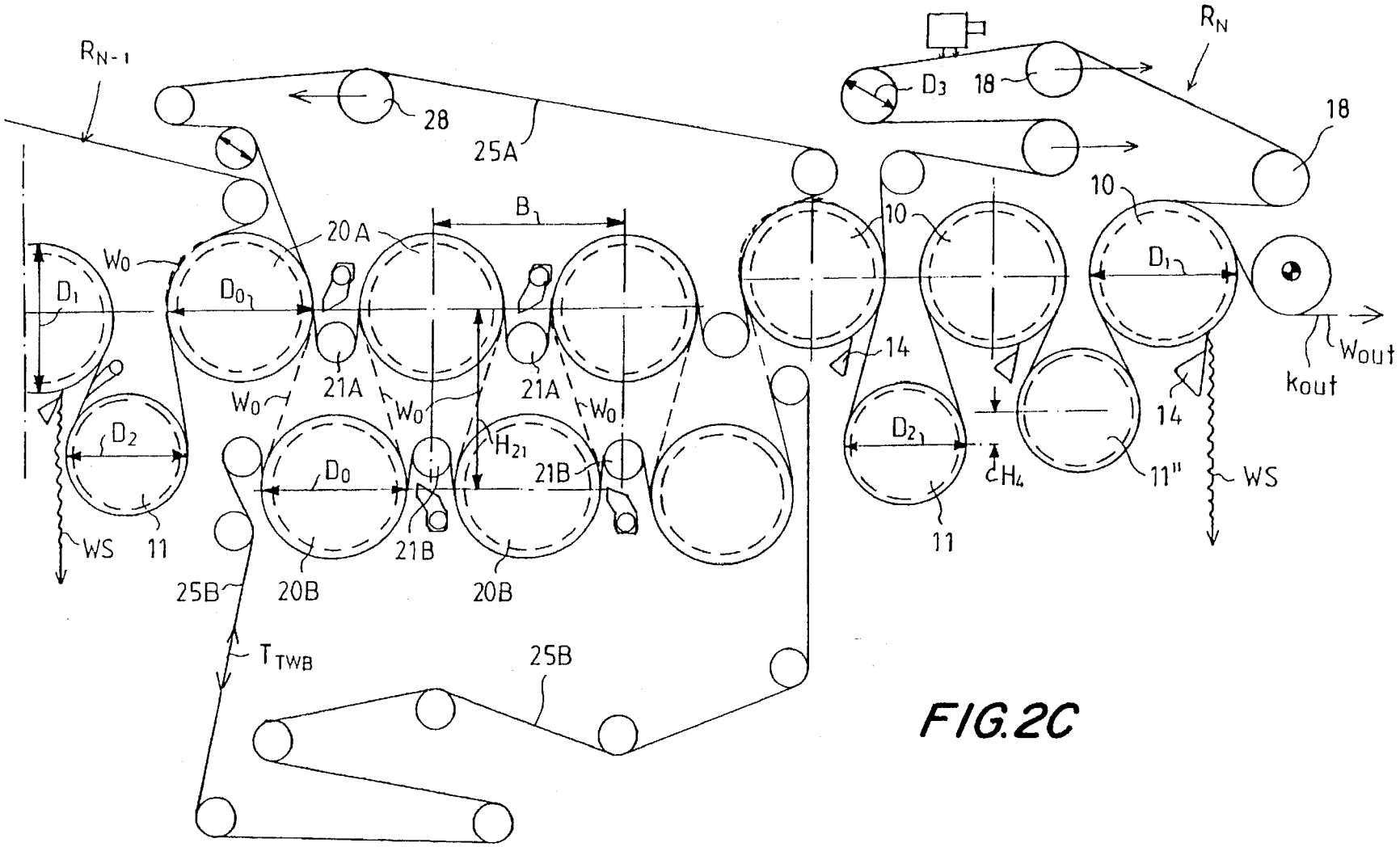
FIG. 2C shows a fifth modification of the dryer section in accordance with the invention.
Figure 2D:
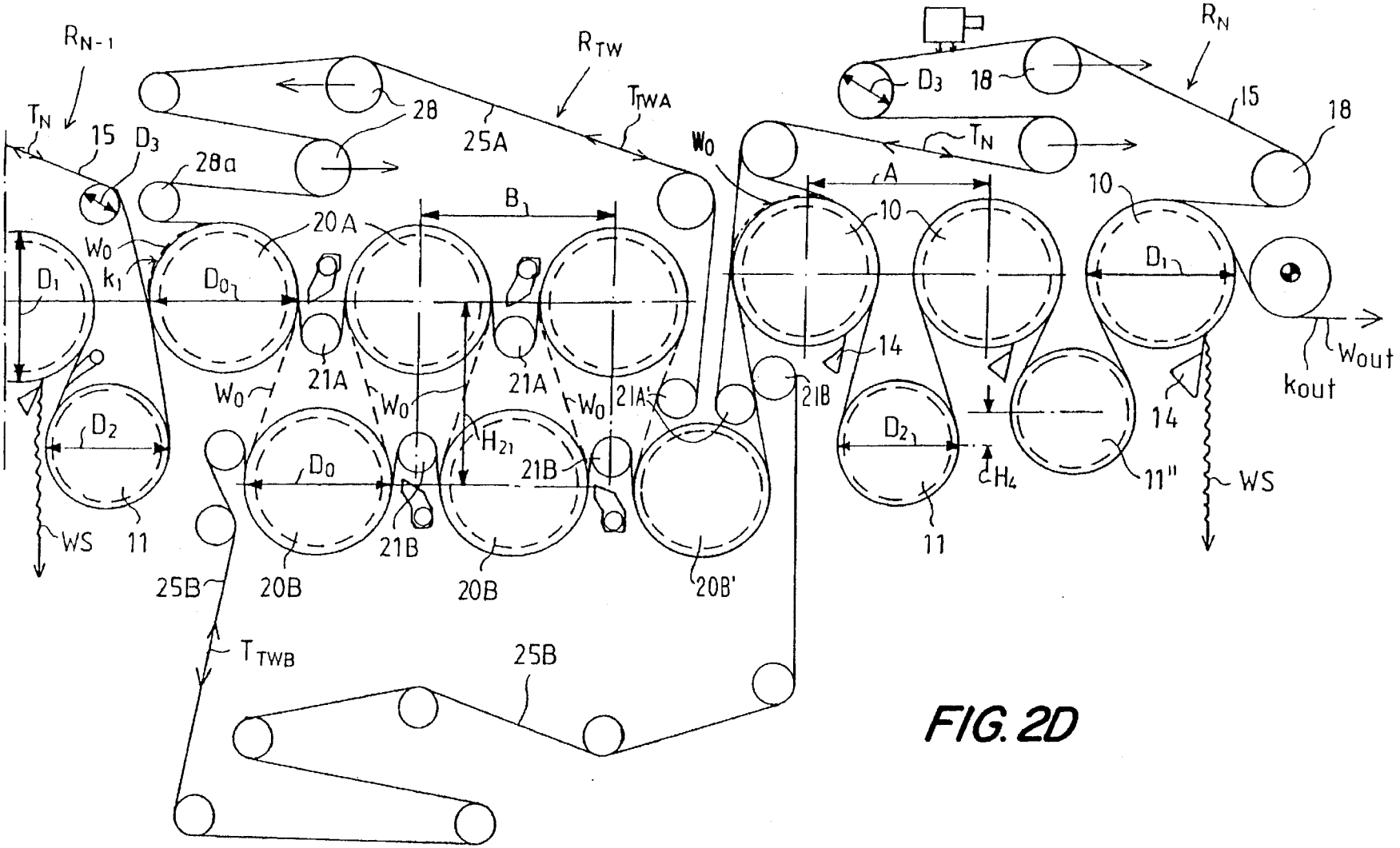
FIG. 2D shows a sixth modification of the dryer section in accordance with the invention.

FIG. 2D shows an embodiment in which the web is transferred in an closed draw from the twin-wire draw group $R_{TW}$ to the normal group $R_N$. More specifically, the web is carded by the drying wire 25B against the outer face of heated drying cylinder 20B', which is the last drying cylinder in the lower row, to a guide roll 21B after which the web is separated from the drying wire 25B. Prior to the separation of the web from the drying wire 25B, the drying wire 15 of the normal group $R_N$ is directed over a guide roll 21A' situated in opposed relationship to guide roll 21B into engagement with the web so that upon separation of the drying wire 25B from the web, the web is carried on the drying wire 15 into and through the normal group $R_N$. This web transfer is a so-called "sandwich group gap".

The scope of the invention also includes embodiments in which the free gaps $W_o$, described above, between the rows of cylinders 20A,20B in the single group $R_{TW}$ with twin-wire draw, which group is placed as the penultimate wire group, have been replaced by fully or partially closed draw arrangements which are in themselves known in the prior art. In this connection, the twin-wire draw group in the dryer section shown in FIG. 2A has fully closed draws between the upper row of drying cylinders 20A and the lower row of drying cylinders 20B. With respect to these draw arrangements, reference is made to FIGS. 3 and 4 in the assignee's Finnish Patent No. 68,279 (corresponding to the assignee's U.S. Pat. No. 4,602,439, the specification of which is hereby incorporated by reference herein), to U.S. Pat. No. 3,753,298, and to the paper by Lindberg, Juppi, Eskelinen, "High Speed Dryer Section Developments for Sheet Stability", 78th Annual Meeting, Technical Section CPPA, 1992.

In the present invention, it is preferable to apply so-called ropeless threading. Ropeless threading can be applied in the normal groups $R_1, \ldots, R_N$ by means of the drying wires 15 and by means of the reversing suction cylinders 11 as well as on the straight runs of the wires placed in connection with them by means of blow boxes 17 and by means of negative pressure applied to the reversing suction cylinders 11. Substantially similar arrangements can also be used in the penultimate single group $R_{TW}$ with twin-wire draw. If necessary, at the doctors 14 and 24, it is also possible to use blow arrangements by whose means the threading is promoted. With respect to these arrangements, reference is made to the assignee's Finnish Patent Application No. 904841 (corresponding to the assignee's U.S. patent application Ser. No. 07/766,039, the specification of which is hereby incorporated by reference herein).

FIG. 2 includes a schematic illustration of the paper tail cutting device 19, preferably a water jet device, which is placed below the first cylinder 10 in the last single-wire group $R_N$ and by whose means the leader of the web is cut apart from the rest of the web and then widened to full width at the end of the tail threading.

As to the dimensioning of the various cylinders and rolls in the dryer section, it should be stated that the diameters $D_1$ of the drying cylinders 10 in the normal groups $R_N$ are advantageously substantially equal to the diameters $D_0$ of the cylinders 20A and 20B in the single twin-wire group $R_{TW}$, i.e., $D_1 \approx D_0$. Generally, the diameters $D_1$ and $D_0$ are selected so that $D_0 \approx D_1 \leqq 2.5$ meters, preferably $D_1 \approx D_0 \approx$ about 1.8 to about 2.2 m. The diameter $D_2$ of the reversing suction cylinders 11 or of corresponding normal suction rolls is generally selected in a range from about 0.6 m to about 1.8 m, most appropriately $D_2$ is from about 1 m to about 1.5 m. The diameter $D_2$ range whereby it is less than 1 m is generally used in narrower machines only. FIG. 2 also shows the horizontal distance A between the cylinders in a normal group $R_N$ and the corresponding horizontal distance B in the single twin-wire group $R_{TW}$, which distances are in FIG. 2: A=about 2130 mm and B=about 2430 mm, when $D_0=D_1$. In this case, in the normal groups $R_1, \ldots, RN$, the vertical distance (H1) between the cylinders 10,11 is about 1600 mm, and in the twin-wire group $R_{TW}$, the corresponding vertical distance (H2) between the cylinders 20A and 20B is about 2000 mm. In FIG. 2, the last reversing cylinder 11" in the last single wire group $R_N$ is shown to be placed at a level by the vertical distance $H_4$ higher than the preceding two reversing cylinders 11*h* in the same group. Vertical distance $H_4$ is preferably dimensioned in a range from about 200 mm to about 400 mm. The diameter D3 of the guide rolls 18,28,28*a*,21*a*,21*b* is typically in a range of from about 400 to about 700 mm, depending on the width of the machine.

A regulation parameter that can be utilized in the invention and by whose means the symmetry of the drying of the opposite sides of the web W can be controlled is the tensions $T_N$ and $T_{TW}$ of the drying wires 15 and 25A,25B. In a preferred embodiment of the invention, $T_N$ is selected in a range from about 2 kN/m to about 4 kN/m, and $T_{TW}$ is selected to be in a range of from about 3 kN/m to about 6 kN/m. It is also possible to use an arrangement of tension of the drying wires 15 in which, also in a normal group $R_1, \ldots, R_N$, the wire tension $T_N$ is increased constantly as the drying makes progress, in accordance with the principles that are described in the assignee's Finnish Patent No. 83,441.

Moreover, the wire tensions $T_{TWA}$ and $T_{TWB}$ of the lower and the upper wire 25A and 25B in the single twin-wire group $R_{TW}$, which is the second to last wire group, can also be selected to be different from one another if the symmetry of the drying of the web W should require. Such an embodiment is particularly advantageous in which the tension $T_{TWB}$ of the wire 25B of the lower cylinders 20B is higher than the tension $T_{TWA}$ of the upper wire 25A. Hereby, the symmetry of drying is promoted in the single twin-wire group $R_{TW}$ by drying the upper side of the web W to a greater extent. The symmetry of drying can also be promoted by in the twin-wire group $R_{TW}$ using different steam pressures and cylinder-face temperatures in the upper cylinders 20A as compared with the lower cylinders 20B. Preferably, in the lower cylinders 20B, a higher steam pressure and cylinder-face temperature are employed than in the upper cylinders 20A, whereby, together with the difference in tension $T_{TWB} > T_{TWA}$ between the wires 25A and 25B, the symmetry of the drying of the web W is promoted further in the single twin-wire group $R_{TW}$ by drying the upper face of the wire W to a greater extent than the lower face. The drying proportion of the lower face was in the normal groups $R_1, \ldots, R_{N-1}$, owing to the cylinders 10, higher than the drying of the upper face. The above symmetry of drying can be promoted further by Choosing different permeabilities of the upper wire 25A and the lower wire 25B. Moreover, if necessary, the symmetry of drying can be increased by selecting the diameter $D_0$ of the lower cylinder 20*b* in the group $R_{TW}$ to be larger than the diameter of the upper cylinder 20*a* and/or by arranging the web-covering sector on the lower cylinder 20*b* to be larger than on the upper cylinder 20*a*.

When the web W departs from the dryer section at $W_{out}$, its dry solids content $k_{out}$ is usually in a range from about 92% to about 98%, whereas the dry solids content of the web W on its arrival in the dryer section ($k_{in}$) is from about 40% to about 50%.

The scope of the invention includes such a modification of a dryer section as shown in FIG. 1 in which, for example, the last two groups among the single-wire groups $R_{N-1}$ are particular groups of inclined alignments, in which the first three contact-drying cylinders are placed in a plane that is inclined downwards in the direction of progress of the web W, and the next three corresponding cylinders are placed in an upwards inclined plane. With respect to these inclined groups, reference is made to FIG. 3 in Finnish Patent Application No. 934367. Instead of inclined groups, it is also possible to use vertical or almost vertical cylinder groups. With respect to such vertical groups, reference is made to the assignee's Finnish Pat. Nos. 53,333 and 82,097 (corresponding to the assignee's U.S. Patent Nos. 3,868,780 and 4,972,608, respectively, the specifications of which are hereby incorporated by reference herein) as well as to U.S. Pat. No. 5,177,880 assigned to Messrs. J. M. Voith GmbH. At least the lower parts of the inclined groups may extend to below the floor level of the paper machine hall into its basement space.

The scope of the invention also includes embodiments in which the overall length of the dryer section has been made shorter in respect of the groups $R_1, \ldots, R_{N-1}$ with single-wire draw by, in one or several groups $R_1, \ldots, R_{N-1}$ fitting the drying cylinders 10 in two or more horizontal, vertical or inclined planes.

The examples provided above are not meant to be exclusive. Many other variations of the present invention would be obvious to those skilled in the art, and are contemplated to be within the scope of the appended claims.

I claim:

1. A dryer section of a paper machine for drying a paper web, comprising a plurality of successively arranged normal groups with single-wire draw, each of said normal groups including drying cylinders arranged in a first row, reversing suction cylinders or suction rolls arranged in a second row below said first row, and a drying wire for carrying the web over said drying cylinders and said reversing suction cylinders or suction rolls, the web having closed draws in group gaps formed between adjacent ones of said plurality of successively arranged normal groups, a single group with twin-wire draw arranged after a last one of said successively arranged normal groups in a running direction of the web, said single group with twin-wire draw including first and second rows of drying cylinders placed one above the other, guide rolls arranged between adjacent ones of said drying cylinders in each of said first and second rows, and a pair of drying wires each pressing the web against the surface of said drying cylinders in a respective row and carrying the web over said drying cylinders in said respective row and said guide rolls arranged between adjacent ones of said drying cylinders in said respective row, the number of said successively arranged normal groups with single-wire draw and number of said drying cylinders in each of said successively arranged normal groups with single-wire draw and the number of said drying cylinders in said single group with twin-wire draw being such that the web attains a dry solids content of 75% at a point within said single group with twin-wire draw and the dry solids content of the web is raised to 90% in said single group with twin-wire draw, and an additional normal group with single-wire draw following directly after said single group with twin-wire draw in the running direction of the web, said additional normal group constituting the last drying group in the dryer section and including drying cylinders arranged in a first row, reversing suction cylinders or suction rolls arranged in a second row below said first row, and a drying wire for carrying the web over said drying cylinders and said reversing suction cylinders or suction rolls.

2. The dryer section of claim 1, further comprising air-blow means for enhancing the support contact on joint runs of said drying wire and the paper web from said drying cylinders in said first row of at least one of said normal groups to said reversing suction cylinders or suction rolls in said second row in said at least one of said normal groups.

3. The dryer section of claim 1, wherein the web has free, unsupported draws as it runs between said first row of drying cylinders in said single group with twin-wire draw and said second row of drying cylinders in said single group with twin-wire draw.

4. The dryer section of claim 1, wherein the web has closed draws as it runs between said first row of drying cylinders in said single group with twin-wire draw and said second row of drying cylinders in said single group with twin-wire draw, the web being transferred from a run on only a first one of the pair of drying wires to a run on only a second one of the pair of drying wires between said first row of drying cylinders and said second row of drying cylinders.

5. The dryer section of claim 1, wherein the horizontal length in a machine direction of said single group with twin-wire draw is about 10% to about 20% of the overall horizontal length of the dryer section in the machine direction.

6. The dryer section of claim 1, wherein said plurality of successively arranged normal groups consists of between 3 and 9 normal groups, the number of said drying cylinders in each of said plurality of successively arranged normal groups is from about 4 to about 8, the total number of said drying cylinders in said single twin-wire group is from about 4 to about 14, the number of said drying cylinders in said additional normal group with single-wire draw is from about 2 to about 5, and the number of said reversing suction cylinders or suction rolls in said additional normal group with single-wire draw is from about 2 to about 5.

7. The dryer section of claim 1, wherein in at least one of said plurality of successively arranged normal groups with single wire draw and said additional group with single wire draw, said drying cylinders are arranged in at least two horizontal.

8. The dryer section of claim 1, further comprising means for producing pressure differences and/or for directing air blowings to provide ropeless tail threading in all of said successively arranged normal groups and in said single group with twin-wire draw.

9. The dryer section of claim 1, wherein said single group with twin-wire draw further comprises a first wire to press the web against said drying cylinders in said first row of said drying cylinders, a second wire to press the web against said drying cylinders in a second row of drying cylinders, and wire guide rolls for supporting said first and second wires, further comprising air-blow boxes arranged in spaces between adjacent ones of said drying cylinders in said first row of drying cylinders in said single group with twin-wire draw and/or adjacent ones of said drying cylinders in said second row of drying cylinders in said single group with twin-wire draw, said air-blow boxes directing blowings in different directions and at different velocities to said first and second drying wires and to said wire guide rolls to promote support contact between said first and second drying wires and the paper web, reduce fluttering of free draws of the paper web and/or promote ventilation of closed pocket spaces defined in gaps between said first and second rows of said drying cylinders.

10. The dryer section of claim 9, said drying cylinders in said first row of said drying cylinder operate at different steam pressures than said drying cylinders in said second row of said drying cylinders.

11. The dryer section of claim 9, wherein said first wire has a different wire tension than said second wire.

12. The dryer section of claim 1, wherein said first row of drying cylinders in said single group with twin-wire draw is situated above said second row of drying cylinders in said single group with twin-wire draw, at least one of the last of said drying cylinders in said last normal group preceding said single group with twin-wire draw being arranged at a height level corresponding to a height level at which said drying cylinders in said first row of drying cylinders in said single group with twin-wire draw are arranged.

13. The dryer section of claim 1, wherein said drying wire in said last normal group with single-wire draw preceding said single group with twin-wire draw carries the web into contact with a first drying cylinder in said first row of drying cylinders in said single group with twin-wire draw to thereby provide a closed draw of the web in its transfer from said last normal group with single-wire draw to said single group with twin-wire draw.

14. The dryer section of claim 1, wherein one of said pairs of drying wires in said single group with twin-wire draw carries the web into contact with a first drying cylinder in said additional normal group with single-wire draw arranged after said single group with twin-wire draw to thereby provide a closed draw of the web in its transfer from said single-wire draw to said single group with twin-wire draw to said additional normal group with single-wire draw.

15. The dryer section of claim 1, wherein said drying wire in said last normal group with single-wire draw preceding said single group with twin-wire draw wraps around a contact sector of a first drying cylinder in said first row of drying cylinders in said single group with twin-wire draw to thereby provide a closed draw of the web in its transfer from said last normal group with single-wire draw to said single group with twin-wire draw.

16. The dryer section of claim 1, wherein one of said pairs of drying wires in said single group with twin-wire draw wraps around a contact sector of a first drying cylinder in said additional normal group with single-wire draw arranged after said single group with twin-wire draw to thereby provide a closed draw of the web in its transfer from said single-wire draw to said single group with twin-wire draw to said additional normal group with single-wire draw.

17. The dryer section of claim 1, further comprising a first guide roll arranged in a loop of a first one of said pair of drying wires in said single group with twin-wire draw after a last one of said drying cylinders in said first row of drying cylinders, the web being carried by said first drying wire into contact with said last drying cylinder in said first row of drying cylinders and after said last drying cylinder in said first row of drying cylinders toward said guide roll, and a second guide roll arranged in a loop of said drying wire in said additional normal group with single-wire draw in opposed relationship to said first guide roll, said drying wire in said additional normal group being directed over said second guide roll into engagement with the web on said first drying wire such that a closed draw of the web is provided between said single group with twin-wire draw and said additional normal group.

18. The dryer section of claim 1, wherein the dryer section comprises only normal groups with single-wire draw before said single group with twin-wire draw.

19. The dryer section of claim 1, wherein in at least one of said plurality of successively arranged normal groups with single wire draw and said additional group with single wire draw, said drying cylinders are arranged in at least two inclined planes so that the overall length of the dryer section is shorter.

20. The dryer section of claim 1, wherein in at least one of said plurality of successively arranged normal groups with single wire draw and said additional group with single wire draw, said drying cylinders are arranged in at least two vertical planes so that the overall length of the dryer section is shorter.

* * * * *